United States Patent [19]

Ohmori et al.

[11] Patent Number: 4,900,459

[45] Date of Patent: Feb. 13, 1990

[54] METAL PROCESSING LUBRICATING OIL COMPOSITION AND PROCESS FOR PRODUCING THE SAME

[75] Inventors: Toshihide Ohmori; Kazuhiko Kitamura; Masuhiko Kawamura; Atsushi Danno, all of Nagoya; Tokuo Shirai, Aichi; Yukio Sugiura, Toyota; Mitsuru Nakane, Okazaki, all of Japan

[73] Assignees: Kabushiki Kaisha Toyota Chuo Kenkyusho, Aichi; Nippondenso Co., Ltd., Kariya; Toyota Chemical Engineering Co., Ltd., Nagoya, all of Japan

[21] Appl. No.: 260,619

[22] Filed: Oct. 21, 1988

[30] Foreign Application Priority Data

May 7, 1988 [JP] Japan ..... 63-111257

[51] Int. Cl.[4] ..... C10M 105/74

[52] U.S. Cl. ..... 252/32.5

[58] Field of Search ..... 252/32.5, 32

[56] References Cited

U.S. PATENT DOCUMENTS

| | | | |
|---|---|---|---|
| 3,983,098 | 9/1976 | Bussi | 252/32.5 |
| 4,085,054 | 4/1978 | Bussi | 252/32.5 |
| 4,115,285 | 9/1978 | van Hesden | 252/32.5 |
| 4,160,089 | 7/1979 | Bussi | 252/32.5 |

FOREIGN PATENT DOCUMENTS

| | | | |
|---|---|---|---|
| 0453408 | 12/1948 | Canada | 252/32.5 |
| 0135932 | 4/1985 | European Pat. Off. . | |
| 2504115 | 8/1975 | Fed. Rep. of Germany | 252/32.5 |
| 2545500 | 4/1976 | Fed. Rep. of Germany | 252/32.5 |

*Primary Examiner*—William R. Dixon, Jr.
*Assistant Examiner*—James M. Hunter, Jr.
*Attorney, Agent, or Firm*—Oblon, Spivak, McClelland, Maier & Neustadt

[57] ABSTRACT

Disclosed are a metal processing lubricating oil composition and a process for producing the same. A metal processing lubricating oil composition according to this invention comprises mineral oil, synthetic oil or a mixture thereof, and phosphoric ester and orthophosphoric acid mixed and heated in the mineral oil, synthetic oil or mixture thereof. The lubricating oil composition gets rid of the tiresome pre-treatment associated with the conventional lubricating method, and exhibits a high seizure prevention performance in cold plastic working only by coating it on workpieces. The lubricating oil composition may further comprise metallic phosphate to suppress corrosivity against ferrous materials.

22 Claims, 5 Drawing Sheets

METAL PROCESSING LUBRICATING OIL COMPOSITION AND PROCESS FOR PRODUCING THE SAME

BACKGROUND OF THE INVENTION

1. Field of the Invention

This invention relates to a high performance lubricating oil composition, which allows easy cold plastic working for metal materials only by coating and which is less corrosive to ferrous materials, and a process for producing the same.

2. Discussion of the Related Art

The following lubricating method has been widely used for cold plastic working for steel: This lubricating method forms zinc phosphate coating with zinc stearate and sodium stearate on workpieces. It has been widely employed because the film formed by this method offers good cold plastic working performance. When this method is applied to workpieces to be plastically cold-worked, it shows a good performance in suppressing the seizure between the workpieces and a die. This method is applicable to a case where a workpiece having a complicated shaped should be formed, and a case where a workpiecé should be processed in severe cold plastic working conditions.

Other than the above lubricating method, a method has been known in which a commercially available or a known lubricating oil is employed. The lubricating oil comprises a base oil mixed with a sulfur additive, a phosphorus additive or zinc dialkyldithiophosphate (hereinafter abbreviated to ZnDTP). This method does not require the film forming as required for the above lubricating method, in which zinc phosphate coating with zinc stearate and sodium stearate is formed on workpieces before cold plastic working. In this method, it is only necessary to apply the lubricating oil by spraying it to a workpiece before cold plastic working. Accordingly, this method has an advantage overcoming the following problems associated with the above lubricating method, in which a metal soap film is formed on workpieces before cold plastic working: A whole cold plastic working process cannot be automated, sludge and scale should be removed and dumped, and the waste of metallic soap solution should be properly treated.

The lubricating method, in which a metal soap film is formed on a workpieces, requires that the above lubricant film is formed before cold plastic working. The above lubricant film forming process comprises the following steps requiring very tiresiome operations and done in the following order: pickling, washing with water, zinc phosphate coating, washing with water, neutralizing, metallic soap coating and drying. Consequently, the lubricant film process cannot be incorporated into a series of processing line ranging from a material cutting process to a cold plastic working process, and shold be left alone as a separate and independent process. Thus, the lubricant film forming process interrupts the operation between the material cutting process and the cold plastic working process in a cold plastic working line employing this lubricating method. As a result, such a cold plastic process automation cannot be realized, and this is a serious problem in satisfying the following requirement assigned to current manufacturing shops: providing required goods in required quantities at required times. Further, sludge and scale should be removed and dumped because they are produced in the phosphate coating process. Furthermore, the waste of metallic soap solution should be properly treated. Therefore, this lubricating method has drawbacks resulting in increased labor, costs and times.

The other method, in which the lubricating oil comprising a base oil mixed with a sulfur additive, a phosphorus additive or ZnDTP is employed, has a poorer seizure prevention performance in cold plastic working than that of the lubricating method in which a metal soap film is formed on workpieces. Accordingly, this method has a critical drawback, i.e. it is only applicable to cold plastic working in milder conditions. Its poor seizure prevention performance results from the fact that the seizure prevention is done only by the lubricating oil film and the reaction film generated during cold plastic working.

SUMMARY OF THE INVENTION

It is therefore an object of this invention to provide a high performance lubricating oil composition whch gets rid of the tiresome pre-treatment only by coating it on a metal material surface before processing.

It is another object of this invention to provide a high performance lubricating oil composition exhibiting a performance equivalent to or higher than that of the lubricating method, in which a metal soap film is formed on workpieces.

A further object of this invention is to provide a high performance lubricating oil composition making cold plastic working for metal materials easier and being less corrosive to ferrous materials, and a process for producing the same.

A lubricating oil composition of this invention comprises mineral oil, synthetic oil or a mixture thereof, and phosphoric ester by 0.1 weight % or more in phosphorus concentration and orthophosphoric acid by 0.1 weight % or more in phosphorus concentration. The composition is then heated at 80° C. or more to form associations of phosphoric ester and orthophosphoric acid.

In addition to the above components, the lubricating oil composition of this invention may further comprise metallic phosphate by 0.01 weight % or more in phosphorus concentration.

The mineral oil, synthetic oil or a mixture thereof is a base oil, i.e. a major component of lubricating oil composition of this invention.

The phosphoric ester may be tributylphosphate, trioctylphosphate, trioleylphosphate, dibutylphosphate, dioctylphosphate, monobutylphosphate, monodecylphosphate, and a mixture of diester and monoester like octyl hydrogen phosphate, decyl hydrogen phosphate and oleyl hydrogen phosphate.

The orthophosphoric acid may be a commercially available aqueous solution of orthophosphoric acid, and the water content may be at one's discretion.

The metallic phosphate may be calcium phosphate, manganese phosphate, iron phosphate and zinc phosphate.

The phosphoric ester may be mixed in the base oil by 0.1 weight % or more in phosphorus concentration, and the content may preferably be from 0.5 to 5 weight % in phosphorus concentration.

The orthophosphoric acid may be mixed in the base oil by 0.1 weight % or more in phosphorus concentration, and the content may preferably be from 0.3 to 5 weight % in phosphorus concentration.

The metallic phosphate may be mixed in the base oil by 0.01 weight % or more in phosphorus concentration, and the content may preferably be from 0.01 to 0.5 weight % in phosphorus concentration.

When the phosphoric ester and orthophosphoric acid contents are less than 0.1 weight % in phosphorus concentration, the effect of their addition decreases. When the phosphoric ester and orthophosphoric acid contents are more than 5 weight % in phosphorus concentration, the performance of lubricating oil composition does not improve any further and their addition is not economical.

When the metallic phosphate content is less than 0.01 weight %, the lubricating oil composition shows corrosion suppressing effect in a lesser degree. When the metallic phosphate content is more than 0.5 weight %, the cold plastic working performance of lubricating oil composition decreases to an unfavorable level.

The lubricating oil composition, in which the phosphoric ester and orthophosphoric acid and/or metallic phosphate are mixed, may be heated at 80° C. or more, and the heating temperature may preferably fall in a range of 100° tio 200° C. Time required for the heat treatment depends on the heating temperature. Namely, when the heating temperature is higher, the heat treatment may take a shorter period of time, and when the heating temperature is lower, the heat treatment may take a longer period of time. However, it is preferable to heat the lubricating oil composition for at least 3 minutes, and more preferably for 15 minutes or more. When the heating temperature is less than 80° C. and the heating period is less than 3 minutes, the cold plastic working performance of lubricating oil composition improves less. On the other hand, when the heating temperature exceeds 200° C., it is not economical because the mineral oil as the base oil degrades and the cold plastic working performance of lubricating oil composition does not improve any more. While heating the lubricating oil composition, it may be stirred with a stirrer, or it may be stood still. It is preferred to carry out the heating in an open system rather than a closed system. After the heating, the lubricating oil composition may be cooled to room temperature by any method.

In case, metallic phosphate is further added to the above lubricating oil composition and undissolved metallic phosphate remains in the lubricating oil composition after heating, the undissolved metallic phosphate is removed by filtering. After the filtering, the lubricating oil composition may be cooled to room temperature by any method as mentioned above.

The lubricating oil composition thus produced contains the associations of phosphoric ester and orthophosphoric acid. The concentration and degree of associations depend on the contents of phosphoric ester and orthophosphoric acid and the conditions of heating, i.e. heating temperature and heating time, and they can not be expressed explicitly. After the heating, however, it is preferable that a spectrum of $^1$H—NMR analysis on the lubricating oil composition exhibits the following: decrease in height of peak resulting from the hydrogen atom of —OH group of free orthophosphoric acid and shift of the peak to lower magnetic field, and increase in height of peak resulting from the hydrogen atom of —OH group of phosphoric ester. Thus, qualitatively, it is preferred to verify that the association is occurred between the phosphoric ester and orthophosphoric acid by the heating, and quantitatively, it is preferred that the integrated value of peak resulting from the hydrogen atom of —OH group of orthophosphoric acid decreases by 90% or less after the heating.

If necessary, the following may be added to the lubricating oil composition of this invention: a compatibility improving agent for improving solubility of the components, a dispersion agent for improving dispersibility of the components, an antioxidation agent for improving the thermal stability of lubricating oil composition, and a corrosion prevention agent for improving the anticorrosion property of the lubricating oil composition.

The orthophosphoric acid used in this invention is an aqueous solution. Consequently, obtained lubricating oil composition is a heterogeneous solution when the phosphoric ester and orthophosphoric acid are only added to the base oil. The phosphoric ester is dissolved mainly in the oil phase, and the orthophosphoric acid is dissolved mainly in the aqueous phase. Accordingly, the phosphoric ester and orthophosphoric acid interact less.

But when the lubricating oil composition is heated, the water evaporates and the water content in the lubricating oil composition decreases. As a result, the phosphoric ester and orthophosphoric acid interact more and the association develops with the hydrogen bond formed between the phosphoric ester and orthophosphoric acid. The higher the heating temperature becomes and the larger the heating time becomes, the more the association develops between the phosphoric ester and orthophosphoric acid. The association develops until it reaches the saturation.

Following structural formulas show the associations comprising one molecule of phosphoric esters and one molecule of orthophosphoric acid. The association in this invention basically results from the hydrogen bond between P—OH and O=P, i.e. [P—OH . . . O=P]. The manner of association is basically identical whether the phosphoric ester is monoester, diester or triester. The association may comprise not only the two molecules as illustrated below, but also a plurality of molecules successively bonded with the hydrogen bonds.

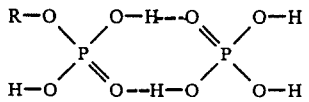

Association of Phosphoric Monoester & Orthophosphoric Acid

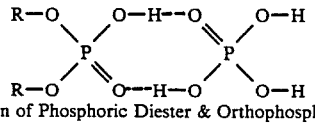

Association of Phosphoric Diester & Orthophosphoric Acid

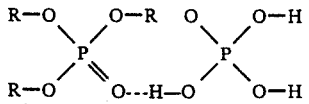

Association of Phosphoric Triester & Orthophosphoric Acid

Note; R represents an alkyl group or an aryl group.

Spectra of $^1$H—NMR analysis on the lubricating oil compositions comprising orthophosphoric acid and oleyl hydrogen phosphate; a mixture of phosphoric monoester and phosphoric diester are illustrated in FIG. 5, and they will be described later in DETAILED DESCRIPTION OF THE PREFERRED EMBODIMENTS section. Here, it is enough to observe that the hydrogen bond is generated between —OH group and O=P group and the association is formed after the heating. Although only the following is observed to verify that the association develops between the phosphoric triester and orthophosphoric acid in the case where the lubricating oil composition contains phosphoric triester, it could be verified that the association develops even between the phosphoric triester and orthophosphoric acid from the results of anaylsis on the cases where the lubricating oil comprises phosphoric monoester or diester and from the fact that the hydrogen bond generated between —OH group and O=P group can result in forming the association. Namely, in case where the lubricating oil comprises phosphoric triester, the following is observed: no peak ① appears but only peak ② resulting from orthophosphoric acid appears in the spectrum like FIG. 5 because the phosphoric triester does not have —ON group in its molecule. Peak ② decreases the height and shifts to lower magnetic field, i.e. to the left, after heating.

The association of phosphoric ester and orthophosphoric acid has much greater reactivity to steel than those of free phosphoric ester and orthophosphoric acid. Since the lubricating oil composition of this invention comprises the phosphoric ester and orthophosphoric acid mixed and heated in the base oil, a strong reaction film comprising iron phosphate is formed on the surfaces of steel material when the lubricating oil composition of this invention is coated on the surfaces of steel material and the steel material is processed.

The metallic phosphate itself hardly dissolves in the base oil. If the metallic phosphate coexists with the phosphoric ester and orthophosphoric acid, it dissolves in the base oil by forming association or complex among the three. The metallic phosphate has low reactivity to metals. Accordingly, when the reaction time is short as in the forging, the metallic phosphate hardly reacts with the surfaces of metal materials and does not hinder the reaction between the surfaces of metal materials and phosphoric ester and orthophosphoric acid. On the other hand, when the lubricating oil composition contacts with the surfaces of metal materials in a longer period of time, the formation of stable reaction film on the surfaces of metal materials depends on components of lubricating oil composition and conditions of the surfaces of metal materials. When the lubricating oil composition contains the metallic phosphate, not only excessive reaction between the surfaces of metal materials and phosphoric ester and orthophosphoric acid can be prevented, but also coming-off and dissolving of the reaction film can be prevented.

The reaction film obtained from the lubricating oil composition of this invention offers better lubrication in the cold plastic working than the conventional lubricating oil applied by coating and the lubricating oil composition obtained only by mixing the base oil with the phosphoric ester and orthophosphoric acid do.

The lubricating oil composition of this invention has remarkably great reactivity to the surfaces of metal materials, and a reaction film having sufficient strength can be formed quickly and simultaneously with the cold plastic working only by coating it on the surfaces of metal materials. Further, when the metallic phosphate is added to the lubricating oil composition, excessive action of the lubricating oil composition to the surfaces of metal materials can be suppressed. Namely, when the lubricating oil composition of this invention contains the metallic phosphate, the lubricating oil composition can be made less corrosive to ferrous materials.

The reaction film obtained from the lubricating oil composition of this invention is appropriate for preventing the seizure in the cold plastic working for metals. Accordingly, when products should be manufactured under sever cold working conditions to which the conventional lubricating oils have not been applicable, such products can be manufactured by cold plastic working by only applying the lubricating oil composition of this invention to them.

DETAILED DESCRIPTION OF THE PREFERRED EMBODIMENTS

First Preferred Embodiments

Paraffinic mineral oil having a kinematic viscosity of 96 cSt. at 40° C., trioleylphosphate, dioctylphosphate and oleyl hydrogen phosphate as phosphoric ester, and orthophosphoric acid were employed to prepare 10 types of lubricating oil compositions listed in Table 1, i.e. Nos. 1 through 10. Quantities in parentheses in Table 1 are phosphorus concentrations expressed in weight %. The phosphoric esters and orthophosphoric acid were mixed in the paraffinic mineral oil to obtain the compositions having the phosphorus concentrations. Lubricating oil composition Nos. 1, 3 and 5 were heated at 150° C. for 1 hour.

Figure 1:
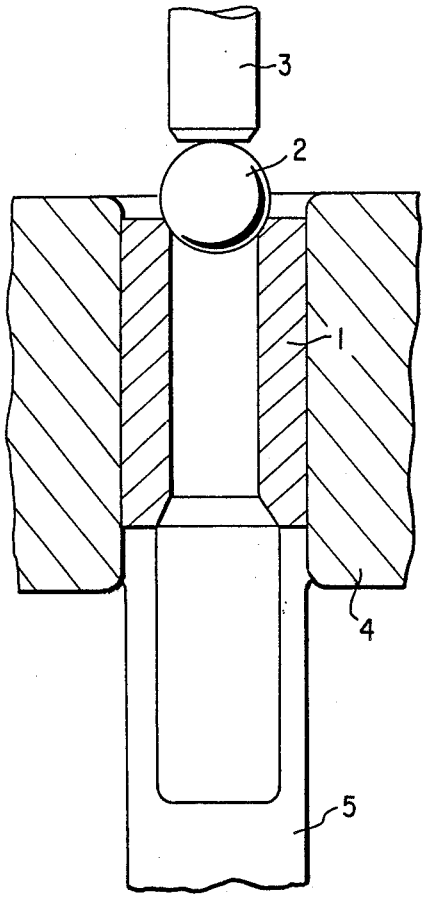
FIG. 1 is a cross-sectional view for schematically illustrating an arrangement of a testing apparatus employed for a ball inserting test.

Then, reaction films obtained from these lubricating oil compositions were evaluated on their cold plastic working performance by a ball inserting test. FIG. 1 illustrates the arrangement of a testing apparatus employed for the ball inserting test. The testing apparatus includes a die 4 made of high speed tool steel and having a through bore of 30 mm inside diameter, a cylindrical test piece 1 having 29.8 mm outside diameter and a center bore of various inside diameters and disposed in the through bore of die 4, a counter punch 5 disposed at the bottom end of the through bore of die 4, and a ball 2 having diameter larger than the inside diameter of the center bore of test piece 1 and disposed at the top end of the test piece 1. The ball 2 is pushed into in the center bore of test piece 1 by a 250 ton knuckle joint press to evaluate seizure between the test piece 1 and ball 2.

For the test piece 1, two types of test pieces 1 as listed in Table 2 were prepared. They were made of low carbon steel, S10C as per Japanese Industrial Standards (hereinafter referred to as JIS), and had a center bore having inside diameter of 14.5 and 15.0 mm. The surfaces of test pieces 1 were coated with one of the lubricating oil compositions listed in Table 1.

For the ball 2, three types of balls 2 were prepared. They were made of steel for bearing, SUJ2 as per JIS, and had diameter of 15.88, 16.67 and 17.46 mm. The ball inserting test was performed after combining the diameter of ball 2 (db) and the inside diameter of center bore (di) of test piece 1 as listed in Table 2.

The reduction in cross-section area (R) in the ball inserting tests were 4, 6, 8, 10, 12 and 14%. Here, the surface area reduction rate (R) is calculated by the following equation:

$$R(\%)=\{(db^2-di^2)/(30^2-di^2)\}\times 100$$

The greater surface area reduction rate means that the cold plastic working condition becomes severed and that the seizure is more likely to occur. The cold plastic working performance of lubricating oil compositions was evaluated by visually observing the inner surface of test piece 1 and by examining the maximum surface area reduction rate (Rmax) which allows the cold plastic working free from the seizure. The greater maximum surface area reduction rate (Rmax) means that the lubricating oil composition shows high performance in a cold plastic working. The testing was done at room temperature.

TABLE 1

| No. | Components (Phosphorus Concentration in Weight %) | | Heating Condition Temp. (°C.) | Time (h.) |
|---|---|---|---|---|
| 1 | Trioleylphosphate | (1.0) | 150 | 1 |
| | Orthophosphoric acid | (0.54) | | |
| 2 | Trioleylphosphate | (1.0) | * | * |
| | Orthophosphoric acid | (0.54) | | |
| 3 | Dioctylphosphate | (1.0) | 150 | 1 |
| | Orthophosphoric acid | (0.54) | | |
| 4 | Dioctylphosphate | (1.0) | * | * |
| | Orthophosphoric acid | (0.54) | | |
| 5 | Oleyl hydrogen phosphate | (1.0) | 150 | 1 |
| | Orthophosphoric acid | (0.54) | | |
| 6 | Oleyl hydrogen phosphate | (1.0) | * | * |
| | Orthophosphoric acid | (0.54) | | |
| 7 | Trioleylphosphate | (1.0) | * | * |
| 8 | Dioctylphosphate | (1.0) | * | * |
| 9 | Oleyl hydrogen phosphate | (1.0) | * | * |
| 10 | Orthophosphoric acid | (0.54) | * | * |

Lines marked with "*" mean that no heating was performed.

TABLE 2

Figure 2:
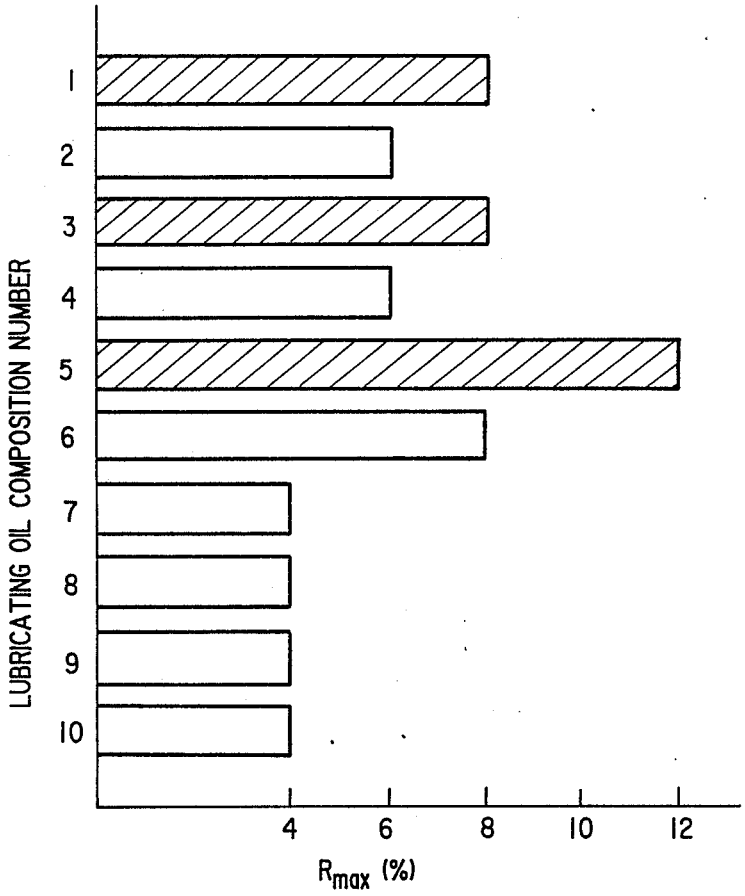
FIG. 2 is a graph showing results of the ball inserting test conducted on lubricating oil compositions listed in Table 1.

| di (mm) | db (mm) | R (%) | di (mm) | db (mm) | R (%) |
|---|---|---|---|---|---|
| | 15.88 | 4 | | 15.88 | 6 |
| 15.0 | 16.67 | 8 | 14.5 | 16.67 | 10 |
| | 17.46 | 12 | | 17.46 | 14 |

di: Inside Diameter of Center Bore of Test Piece 1
db: Diameter of Ball 2
R: Surface Area Reduction Rate; $R(\%) = \{(db^2 - di^2)/(30^2 - di^2)\} \times 100$ FIG. 2 shows results of the ball inserting test. The results show that the lubricating oil compositions of this invention, i.e. Nos. 1, 3 and 5, in which the phosphoric ester and orthophosphoric acid were mixed and heated in the paraffinic mineral oil, exhibited greater maximum reduction in cross-sectional area than lubricating oil composition Nos. 2, 4, 6, 7, 8, 9 and 10 do. Note that lubricating oil composition Nos. 2, 4 and 6 includes both the phosphoric ester and orthophosphoric acid but no heating was performed and also note that lubricating oil composition Nos. 7, 8, 9 annd 10 contain either the phosphoric ester or orthophosphoric acid and no heating was performed. Particularly, lubricating oil composition No. 1 exhibited greater maximum surface area reduction than lubricating oil composition No. 2 does, lubricating oil composition No. 3 exhibited greater maximum surface area reduction than lubricating oil composition No. 4 does, and lubricating oil composition No. 5 exhibited greater maximum surface area reduction than lubricating oil composition No. 6 does. It is thus apparent that the lubricating oil compositions of this invention had an improved cold plastic working performance.

Second Preferred Embodiments

Oleyl hydrogen phosphate as phosphoric ester and orthophosphoric acid were mixed in the same mineral oil employed by the first preferred embodiments, i.e. paraffinic mineral oil. oleyl hydrogen phosphate and orthophosphoric acid contents were respectively 1.0 and 0.54 weight % in phosphorus concentration. Lubricating oil composition No. 11 was heated at 60° C. for 1 hour, lubricating oil composition No. 12 was heated at 80° C. for 1 hour, and lubricating oil composition No. 13 was heated at 120° C. for 1 hour. Thus, three lubricating oil compositions were prepared. Two lubricating oil compositions prepared in the first preferred embodiments, i.e. Nos. 5 and 6, were evaluated together with the above three lubricating oil compositions of these second preferred embodiments. These five lubricating oil compositions are listed in Table 3 below.

TABLE 3

| No. | Components (Phosphorus Concentration in Weight %) | | Heating Condition Temp. (°C.) | Time (h.) |
|---|---|---|---|---|
| 6 | Oleyl hydrogen phosphate | (1.0) | * | * |
| | Orthophosphoric acid | (0.54) | | |
| 11 | Oleyl hydrogen phosphate | (1.0) | 60 | 1 |
| | Orthophosphoric acid | (0.54) | | |
| 12 | Oleyl hydrogen phosphate | (1.0) | 80 | 1 |
| | Orthophosphoric acid | (0.54) | | |
| 13 | Oleyl hydrogen phosphate | (1.0) | 120 | 1 |
| | Orthophosphoric acid | (0.54) | | |
| 5 | Oleyl hydrogen phosphate | (1.0) | 150 | 1 |
| | Orthophosphoric acid | (0.54) | | |

Lines marked with "*" mean that no heating was performed.

Seizure prevention performance in cold plastic working of the five lubricating oil compositions listed in Table 3 were evaluated by the same ball inserting test as described in First Preferred Embodiments section. In addition, a commercially available cold forging lubricating oil with sulfur additive (Comparative Example 1) and another commercially available cold forging lubricating oil with phosphorus additive (Comparative Example 2) were also evaluated by the ball inserting test. Results of this evaluation are illustrated in FIG. 3.

Figure 3:
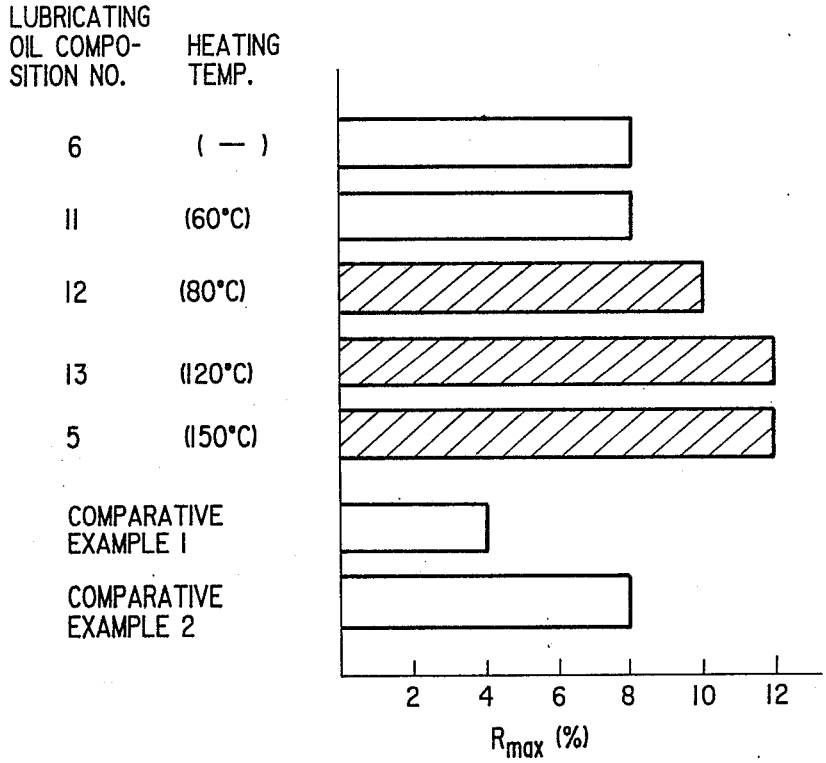
FIG. 3 is a graph showing results of the ball inserting test conducted on lubricating oil compositions listed in Table 3.

It is apparent from FIG. 3 that effects of heating are obvious in the lubricating oil compositions heated at 80° C. or more, i.e., Nos. 12, 13 and 5. Namely, lubricating oil composition Nos. 12, 13 and 5 exhibited greater maximum surface area reduction rate (Rmax) than lubricating oil composition No. 6, which was not subjected to heating, did. Further, Rmax value increased as the temperature of heating increased. Accordingly, it is apparent that seizure prevention performance improved as the temperature of heating increased. Among the heated lubricating oil compositions, the lubricating oil compositions heated at 120° C. or more, i.e. Nos. 13 and 5, was particularly superior in seizure prevention performance to the commercially available forging lubricating oils, i.e. Comparative Examples 1 and 2.

(Quantitative Analysis with X-ray Micro Analyzer)

Then, a quantitative analysis with an X-ray micro analyzer (hereinafter referred to as EPMA) was done in order to examine how the reaction between the lubricating oil compositions and the test pieces 1 developed. First, the test pieces 1 were coated with lubricating oil composition Nos. 5, 6, 9 and 10 of Table 1, and the ball inserting test was conducted at the surface area reduction rate of 4%. The quantitative analysis with the EPMA was then conducted to determine quantities of phosphorus and oxygen elements in the surfaces of test pieces 1 after the ball inserting test. Results of this quantitative analysis are shown in FIG. 4.

Figure 4:
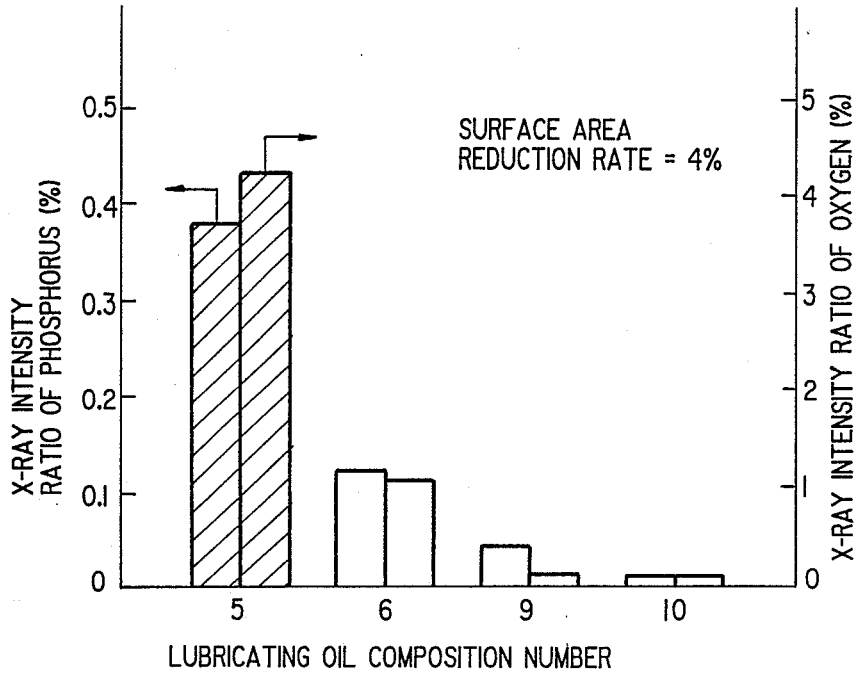
FIG. 4 is a graph showing results of a quantitative analysis with an X-ray micro analyzer (hereinafter referred to as EPMA) on elements in surfaces of test pieces after the ball inserting test.

FIG. 4 reveals that lubricating oil composition No. 5 of this invention formed the reaction film on the inner surface of test piece 1 in greater quantity than lubricating oil composition No. 6, which was not heated, did. It is believed that the reaction film is mainly composed of iron phosphate, and that the seizure prevention performance results from the high reactivity of heated lubricating oil composition to the surfaces of metal materials.

(Spectrometric Analysis on Lubricating Oil Composition)

Figure 5:
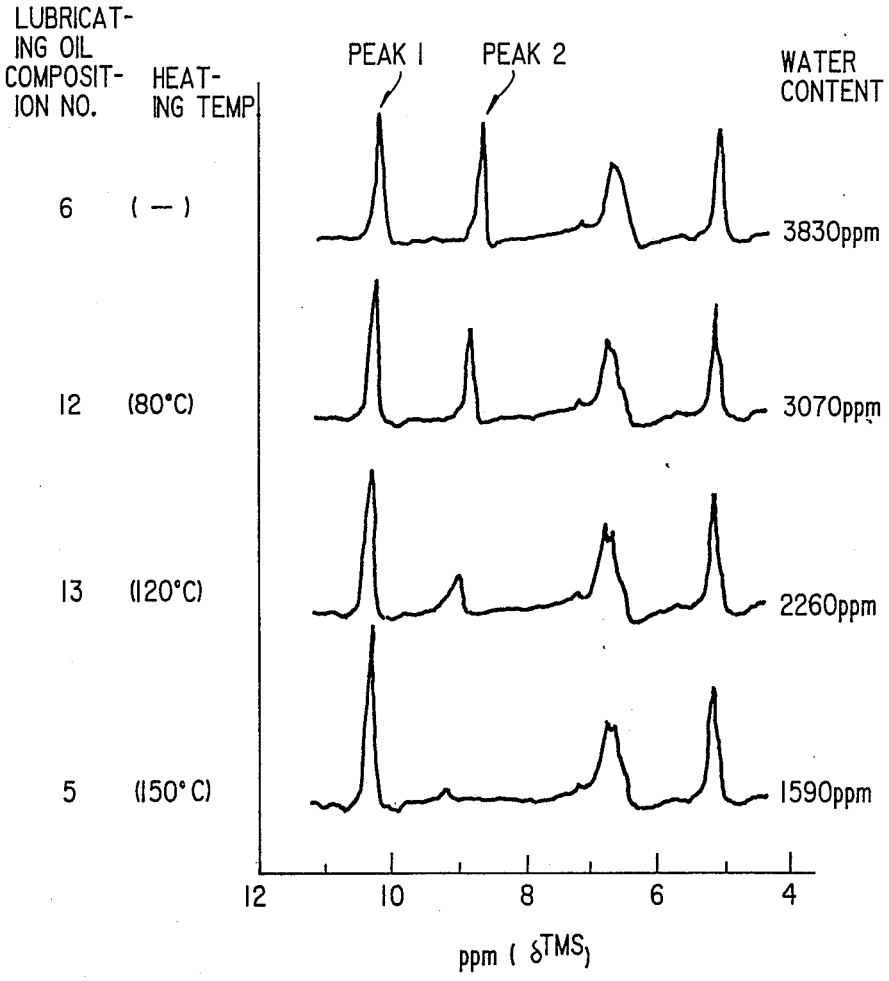
FIG. 5 is a diagram showing results of $^1$H—NMR analysis on the lubricating oil compositions listed in Table 3.

Furthermore, four lubricating oil compositions, i.e. Nos. 6, 12, 13 and 5 of Table 3, were analyzed by $^{1}$H-NMR, $^{31}$P-NMR and infrared spectroscopy, and the water content in the lubricating oil compositions were measured. Results of $^{1}$H-NMR analysis and the water content measurement are shown in FIG. 5, in which $^{1}$H-NMR spectra of the lubricating oil compositions are marked with their respective numbers, heating temperatures and water contents. However, in $^{31}$P-NMR and infrared spectroscopy analyses, no appreciable difference resulting from the heating was seen among lubricating oil compositions Nos. 6, 12, 13 and 5.

In FIG. 5, there appears peak ① clearly separated from peak ② in the spectrum of lubricating oil composition No. 6, which was not subjected to the heating. Peak ① results from the hydrogen of —OH group of oleyl hydrogen phosphate, and peak ② results from the hydrogen of —OH group of orthophosphoric acid. As the heating temperature increases and the water content decreases, peak ② becomes shorter and approaches peak ①, and peak ① becomes taller. Accordingly, the variation in the spectra of $^{1}$H-NMR according to the heating is believed to show that the following had happened: The associations were formed between oleyl hydrogen phosphate and orthophosphoric acid with the hydrogen bond, and the number of associations were increased as the heating temperature increased. Therefore, it is understood that the high reactivity of heated lubricating oil composition of this invention to the surfaces of metal materials resulted from the association between oleyl hydrogen phosphate and orthophosphoric acid, and that the action of association between oleyl hydrogen phosphate and orthophosphoric acid improved the seizure prevention performance in cold plastic working remarkably.

Third Preferred Embodiments

Paraffinic mineral oil having a kinematic vicosity of 96 cSt. at 40° C., oleyl hydrogen phosphate as phosphoric ester, orthophosphoric acid, and calcium phosphate, manganese phosphate, iron phosphate and zinc phosphate as metallic phosphate were employed to prepare 8 types of lubricating oil compositions listed in Table 4, i.e. Nos. 14 through 21.

The same ball inserting test, done in the first preferred embodiments, were conducted to evaluate the cold plastic working performance of reaction film obtained from lubricating oil compositions of these third preferred embodiments.

TABLE 4

| No. | Components (Phosphorus Concentration in Weight %) | | Heating Condition Temp. (°C.) | Time (h.) |
|---|---|---|---|---|
| 14 | Oleyl hydrogen phosphate | (1.0) | 80 | 3 |
| | Orthophosphoric acid | (0.5) | | |
| | Calcium phosphate | (0.02) | | |
| 15 | Oleyl hydrogen phosphate | (1.0) | 80 | 3 |
| | Orthophosphoric acid | (0.5) | | |
| | Manganese phosphate | (0.02) | | |
| 16 | Oleyl hydrogen phosphate | (1.0) | 80 | 3 |
| | Orthophosphoric acid | (0.5) | | |
| | Iron phosphate | (0.11) | | |
| 17 | Oleyl hydrogen phosphate | (1.0) | 110 | 3 |
| | Orthophosphoric acid | (0.5) | | |
| | Zinc phosphate | (0.13) | | |
| 18 | Oleyl hydrogen phosphate | (1.0) | 110 | 3 |
| | Orthophosphoric acid | (0.5) | | |
| 19 | Oleyl hydrogen phosphate | (1.0) | * | * |
| | Orthophosphoric acid | (0.5) | | |
| 20 | Oleyl hydrogen phosphate | (1.0) | * | * |
| 21 | Orthophosphoric acid | (0.5) | * | * |

Lines marked with "*" mean that no heating was performed.

Results of the evaluation are summarized in Table 5. In Table 5, Comparative Example 3 was a commercially available cold forging lubricating oil with phosphorus additive. The results show that the lubricating oil compositions of this invention, i.e. Nos. 14, 15, 16, 17 and 18, in which the phosphoric ester, orthophosphoric acid and/or metallic phosphate were mixed and heated in the paraffinic mineral oil, exhibited greater maximum reduction in cross-sectional area than lubricating oil composition Nos. 19, 20 and 21 did. Note that lubricating oil composition Nos. 19 includes both the phosphoric ester and orthophosphoric acid but no heating was performed and also note that lubricating oil composition Nos. 20 and 21 contain either the phosphoric ester or orthophosphoric acid and no heating was performed. Particularly, lubricating oil composition Nos. 14 through 18 exhibited greater maximum surface area reduction than lubricating oil composition No. 19 did, and lubricating oil composition No. 19 exhibited greater maximum surface area reduction rate than lubricating oil composition Nos. 20 and 21 did. It is thus apparent that the lubricating oil compositions of this invention had an improved seizure prevention performance in cold plastic working. Furthermore, the lubricating oil compositions of this invention had better seizure prevention performance in cold plastic working than Comparative Example 3, the commercially available cold forging lubricating oil with phosphorus additive.

TABLE 5

| Lubricating Oil Composition No. | Rmax Value (%) Obtained by Ball Inserting Test |
|---|---|
| No. 14 | 12 |
| No. 15 | 12 |
| No. 16 | 12 |
| No. 17 | 12 |
| No. 18 | 12 |
| No. 19 | 8 |
| No. 20 | 4 |
| No. 21 | 4 |

TABLE 5-continued

| Lubricating Oil Composition No. | Rmax Value (%) Obtained by Ball Inserting Test |
|---|---|
| Comparative Example 3 | 8 |

Table 6 summarizes results of the quantitative analysis with the EPMA on elements in the surfaces of test pieces 1 after the ball inserting test. The elements to be detected were phosphorus, oxygen and zinc.

TABLE 6

| Lubricating Oil Composition No. | X-ray Intensity Ratio of Elements (%) | | |
|---|---|---|---|
| | Phosphorus | Oxygen | Zinc |
| No. 17 | 0.61 | 5.99 | 0.04 |
| No. 18 | 0.63 | 6.22 | 0 |
| No. 19 | 0.18 | 1.71 | 0 |
| No. 20 | 0.01 | 0.10 | 0 |
| No. 21 | 0.04 | 0.10 | 0 |

Table 6 tells us that lubricating oil compositions Nos. 17 and 18 exhibited greater X-ray intensity rates than lubricating oil composition No. 19 did. Therefore, it is understood from Table 6 that lubricating oil composition Nos. 17 and 18 subjected to the heating generated much reaction film on the surfaces of test pieces 1 than lubricating oil composition No. 19 without being subjected to the heating did. The reaction film is believed to be mainly composed of iron phosphate. Thus, it is apparent that the high reactivity of heated lubricating oil compositions contributed to the high seizure prevention performance in cold plastic working. The high reactivity resulted from the association formed between phosphoric ester and orthophosphoric acid by heating.

Further, in lubricating oil composition No. 17 with zinc phosphate added, a trace of zinc was detected as summarized in Table 6. Accordingly, zinc phosphate, i.e. the metallic phosphate, did not take part in the reaction with iron surfaces. Namely, the metallic phosphate does not react with the iron surfaces in the reaction like the cold plastic working done in a short period of time. As a result, the metallic phosphate does not hinder the iron phosphate forming reaction, which forms the reaction film effective to high seizure prevention performance in cold plastic working and which results from the action of phosphoric ester and orthophosphoric acid.

(Static Corrosion Test)

Corrosivity of lubricating oil compositions listed in Table 4 against ferrous materials was evaluated by a static corrosion test.

The static corrosion test was done by measuring weight difference of a test piece made of SPCC steel (as per JIS) and by observing surface state of the test piece after immersing and leaving the test piece in the lubricating oil compositions for one week. The surface area ratio of test piece to the amount of lubricating oil compositions was 0.37 $cm^2$ per 1 gram of lubricating oil compositions. The temperatures of lubricating oil compositions and the test piece was kept constant by conducting the static corrosion test in a constant temperature bath.

Table 7 summarizes results of the static corrosion test. In the static corrosion test of lubricating oil composition No. 18, in which only phosphoric ester and orthophosphoric acid were mixed and heated in the paraffinic mineral oil, and Comparative Example 3, i.e. a commercially available cold forging lubricating oil with phosphorus additive, the test pieces dissolved in the lubricating oil composition No. 18 and Comparative Example 3 due to the occurrence of heavy corrosion, and lost their weight. On the other hand, in the static corrosion test of the lubricating oil compositions Nos. 14, 15, 16 and 17, the test pieces did not lost their weight but they gained weight by the weight of reaction film formed on their surfaces resulting from the reaction of phosphoric ester and orthophosphoric acid. Especially, among them, lubricating oil composition No. 16 containing iron phosphate and lubricating oil composition No. 17 containing zinc phosphate corroded the test pieces least, and the surfaces of test pieces immersed in these lubricating oil compositions were in gentle condition. Therefore, it is apparent that the corrosivity of lubricating oil compositions containing phosphoric ester and orthophosphoric acid against ferrous materials has been improved by further mixing the metallic phosphate.

TABLE 7

| Lubricating Oil Composition No. | Test Piece Weight Difference ($mg/cm^2$) [Note 1] | Test Piece Surface Condition [Note 2] | Rank of Improvement [Note 3] |
|---|---|---|---|
| No. 14 | +2.23 | X | D |
| No. 15 | +0.74 | X | D |
| No. 16 | +0.33 | O | B |
| No. 17 | +0.35 | O | B |
| No. 18 | −0.89 | X | F |
| Comparative Example 3 | −0.94 | X | F |

(Test Temperature: 60° C.)
Note 1: +: Weight Gained, −: Weight Decreased
Note 2: O: Gently Affected, Δ: Slighty Roughed, X: Heavily Roughed
Note 3: A: No weight and surface condition differences B: Weight gained and gently affected surface C: Weight gained and slightly roughed surface D: Weight gained and heavily roughed surface E: Weight decreased and gently affected surface F: Weight decreased and heavily roughed surface Table 8 summarizes results of the quantitative analysis with the EPMA on elements in the surfaces of test pieces 1 after the static corrosion test. The elements to be detected were phosphorus, oxygen and zinc.

TABLE 8

| Lubricating Oil Composition No. | X-ray Intensity Ratio of Elements (%) | | |
|---|---|---|---|
| | Phosphorus | Oxygen | Zinc |
| No. 17 | 2.43 | 21.5 | 1.32 |
| No. 18 | 3.70 | 27.4 | 0 |

Table 8 tells us that zinc as well as phosphorus and oxygen were detected in the surfaces of test pieces immersed in lubricating oil composition No. 17 containing zinc phosphate. On the contrary, no zinc was detected in the surfaces of test pieces immersed in lubrication oil composition No. 18 free from the metallic phosphate. Therefore, the following is apparent: When the lubricating oil composition No. 17 and the test piece made of iron were in contact for a long time, zinc phosphate as the metallic phosphate took part in the reaction among phosphoric ester, orthophosphoric acid and the surfaces of test piece. Thus, the metallic phosphate helped to form the stable reaction film less likely to dissolve in the lubricating oil or less likely to come off, and suppressed the corrosion.

Fourth Preferred Embodiments

Phosphoric ester, orthophosphoric acid and metallic phosphate were mixed, heated and stirred in the same mineral oil employed by the third preferred embodiments, i.e. paraffinic mineral oil, to prepare five lubricating oil compositions listed in Table 9. Oleyl hydrogen phosphate and iron phosphate were employed respectively for the phosphoric ester and the metallic phosphate. The oleyl hydrogen phosphate and orthophosphoric acid contents were fixed for all of the five lubricating oil compositions, but the iron phosphate content was varied.

TABLE 9

| No. | Components (Phosphorus Concentration in Weight %) | | Heating Condition Temp. (°C.) | Time (h.) |
|---|---|---|---|---|
| | Oleyl hydrogen phosphate | (1.0) | | |
| 22 | Orthophosphoric acid | (0.5) | 80 | 3 |
| | Iron phosphate | (0.03) | | |
| | Oleyl hydrogen phosphate | (1.0) | | |
| 23 | Orthophosphoric acid | (0.5) | 80 | 3 |
| | Iron phosphate | (0.06) | | |
| | Oleyl hydrogen phosphate | (1.0) | | |
| 24 | Orthophosphoric acid | (0.5) | 80 | 3 |
| | Iron phosphate | (0.08) | | |
| | Oleyl hydrogen phosphate | (1.0) | | |
| 16 | Orthophosphoric acid | (0.5) | 80 | 3 |
| | Iron phosphate | (0.11) | | |
| | Oleyl hydrogen phosphate | (1.0) | | |
| 25 | Orthophosphoric acid | (0.5) | 80 | 3 |
| | Iron phosphate | (0.15) | | |

Seizure prevention performance of the five lubricating oil compositions listed in Table 9 were evaluated by the same ball inserting test as described in the first preferred embodiments. In addition, corrosivity of the lubricating oil compositions listed in Table 9 against ferrous materials was evaluated by the same static corrosion test described in the third preferred embodiments. Table 10 summarizes results of the ball inserting test, and Table 11 summarizes results of the static corrosion test.

It is understood from Table 11 that mixing iron phosphate improved the corrosivity of lubricating oil compositions without decreasing the weight of test pieces. Namely, as in lubricating oil composition No. 22, the effect was obtained by mixing iron phosphate by an extremely small amount of 0.03 weight % in phosphorus concentration. Further, as the iron phosphate content increased, the test piece surface condition was found to be affected more gently and the corrosivity of lubricating oil compositions was also found to be suppressed. However, when the iron phosphate content is increased extremely, the seizure prevention performance in cold plastic working deteriorates. Namely, as in the case of lubricating oil composition No. 25 containing 0.15 weight % of iron phosphate in phosphorus concentration, lubricating oil composition No. 25 exhibited lower Rmax value of 8% as shown in Table 10 and had deteriorated cold plastic working performance. Accordingly, it is necessary to determine the metallic phosphate content in accordance with circumstances to which the lubricating oil composition is coated, i.e. performance required for the lubricating oil composition, application for the lubricating oil composition and so on.

TABLE 10

| Lubricating Oil Composition No. | Rmax Value (%) Obtained by Ball Inserting Test |
|---|---|
| No. 22 | 12 |
| No. 23 | 12 |
| No. 24 | 12 |
| No. 16 | 12 |

TABLE 10-continued

| Lubricating Oil Composition No. | Rmax Value (%) Obtained by Ball Inserting Test |
|---|---|
| No. 25 | 8 |

TABLE 11

| Lubricating Oil Composition No. | Test Piece Weight Difference ($mg/cm^2$) [Note 1] | Test Piece Surface Condition [Note 2] | Rank of Improvement [Note 3] |
|---|---|---|---|
| No. 22 | +0.25 | X | D |
| No. 23 | +0.30 | Δ | C |
| No. 24 | +0.49 | Δ | C |
| No. 16 | +0.33 | O | B |
| No. 25 | +0.28 | O | B |

(Test Temperature: 25° C.)
Note 1: +: Weight Gained, −: Weight Decreased
Note 2: O: Gently Affected, Δ: Slighty Roughed, X: Heavily Roughed
Note 3: A: No weight and surface condition differences B: Weight gained and gently affected surface C: Weight gained and slightly roughed surface D: Weight gained and heavily roughed surface E: Weight decreased and gently affected surface F: Weight decreased and heavily roughed surface

What is claimed is:

1. A metal processing lubricating oil composition, comprising an oil selected from the group consisting of mineral oil, synthetic oil and a mixture thereof, an effective amount of one or more phosphoric esters and orthophosphoric acid, wherein said phosphoric esters and said orthophosphoric acid form associations between each other.

2. The metal processing lubricating oil composition according to claim 1, wherein said mineral oil is paraffinic mineral oil.

3. The metal processing lubricating oil composition according to claim 1, wherein said phosphoric esters are selected from the group consisting of tributylphosphate, trioctylphosphate, trioleylphosphate, dibutylphosphate, dioctylphosphate, monobutylphosphate, monodecylphosphate, octyl hydrogen phosphate, decyl hydrogen phosphate and oleyl hydrogen phosphate.

4. The metal processing lubricating oil composition according to claim 1, comprising said phosphoric esters in the amount of 0.1 weight % or more in phosphorus concentration and said orthophosphoric acid in the amount of 0.1 weight % or more in phosphorus concentration.

5. The metal processing lubricating oil composition according to claim 1, further comprising one or more metallic phosphates.

6. The metal processing lubricating oil composition according to claim 5, wherein said metallic phosphates are selected from the group consisting of calcium phosphate, manganese phosphate, iron phosphate and zinc phosphate.

7. The metal processing lubricating oil composition according to claim 5, comprising said metallic phosphate in the amount of 0.01 weight % or more in phosphorus concentration.

8. The metal processing lubricating oil composition according to claim 4, wherein said phosphoric esters are present in the amount of about 0.5 to 5 weight % in phosphorus concentration.

9. The metal processing lubricating oil composition according to claim 4, wherein said orthophosphoric acid is present in the amount of about 0.3 to 5 weight % in phosphorus concentration.

10. The metal processing lubricating oil composition according to claim 7, wherein said metallic phosphate is present in the amount of about 0.001 to 0.5 weight% in phosphorus concentration.

11. The metal processing lubricating oil composition as claimed in claim 1, wherein said phosphoric esters and said orthophosphoric acid form associations to an extent of at least 90% based upon an integrated nuclear magnetic resonance value for the resonance of the hydrogen atom of the —OH group of orthophosphoric acid.

12. A process for producing a metal processing lubricating oil composition, comprising:

(a) forming a mixture comprising one or more phosphoric esters in the amount of 0.1 weight % or more in phosphorus concentration, orthophosphoric acid in the amount of 0.1 weight % or more in phosphorus concentration and an oil selected from the group consisting of mineral oil, synthetic oil and a mixture thereof;

(b) heating said mixture to a temperature sufficient to form associations of said phosphoric esters and orthophosphoric acid; and (c) cooling the resulting composition to room temperature to obtain said metal processing lubricating oil composition.

13. The process for producing a metal processing lubricating oil composition according to claim 12, wherein said mixture is heated at a temperature of from 100° to 200° C.

14. A process for producing a metal processing lubricating oil composition, comprising:

(a) forming a mixture comprising one or more phosphoric esters in the amount of 0.1 weight % or more in phosphorus concentration, orthophosphoric acid in the amount of 0.1 weight % or more in phosphorus concentration, an oil selected from the group consisting of mineral oil, synthetic oil and a mixture therof, and one or more metallic phosphates for reducing corrosiveness to ferrous materials in the amount of 0.01 weight % or more in phosphorus concentration;

(b) heating said mixture to a temperature sufficient to form associations of said phosphoric esters and orthophosphoric acid;

(c) filtering the resulting composition to remove undissolved metallic phosphates; and (d) cooling said filtered composition to room temperature to obtain said metal processing lubricating oil composition.

15. The process for producing a metal processing lubricating oil composition according to claim 14, wherein said mixture is heated at a temperature of from 100° to 200° C.

16. The process for producing a metal processing lubricating oil composition according to claim 8, wherein said mixture is heated to a temperature of at least 80° C. to form said associations.

17. The process for producing a metal processing lubricating oil composition according to claim 15, wherein said mixture is heated for at least 3 minutes.

18. The process for producing a metal processing lubricating oil composition according to claim 10, wherein said mixture is heated to a temperature of at least 80° C. to form said associations.

19. The process for producing a metal processing lubricating oil composition according to claim 18, wherein said mixture is heated for at least 3 minutes.

20. The process for producing a metal processing lubricating oil composition according to claim 12, wherein said phosphoric ester and said orthophosphoric acid form associations to an extent of at least 90% based upon an integrated nuclear magnetic resonance value for the resonance of the hydrogen atom of the —OH group of orthophosphoric acid.

21. The process for producing a metal processing lubricating oil composition according to claim 14, wherein said phosphoric esters and said orthophosphoric acid form associations to an extent of at least 90% based upon an integrated nuclear magnetic resonance value for the resonance of the hydrogen atom of the —OH group of orthophosphoric acid.

22. The process for producing a metal processing lubricating oil composition according to claim 14, wherein said one or more metallic phosphates are selected from the group consisting of calcium phosphate, manganese phosphate, iron phosphate and zinc phosphate.

* * * * *

UNITED STATES PATENT AND TRADEMARK OFFICE

CERTIFICATE OF CORRECTION

PATENT NO. : 4,900,459

DATED : FEBRUARY 13, 1990

INVENTOR(S) : Toshihide OHMORI et al

It is certified that error appears in the above-identified patent and that said Letters Patent is hereby corrected as shown below:

Column 1, line 51, change "tiresiome" to -- tiresome --;

line 58, change "shold" to -- should --.

Column 2, line 20, change "whch" to -- which --.

Column 5, line 18, change "-ON" to -- -OH --.

Column 7, line 66, change "annd" to -- and --.

Column 11, line 60, change "was" to -- were --.

Claim 16, line 2, change "8" to -- 12 --.

Claim 17, line 2, change "15" to -- 16 --.

Claim 18, line 2, change "10" to -- 14 --.

Signed and Sealed this

Eighteenth Day of August, 1992

*Attest:*

DOUGLAS B. COMER

*Attesting Officer*

*Acting Commissioner of Patents and Trademarks*